US005590429A

United States Patent [19]

Boomgaarden et al.

[11] Patent Number: 5,590,429

[45] Date of Patent: Jan. 7, 1997

[54] ELECTROPHYSIOLOGY TABLE

[75] Inventors: Jonathan C. Boomgaarden; Harold J. Kidd, both of Waukesha, Wis.

[73] Assignee: General Electric Company, Milwaukee, Wis.

[21] Appl. No.: 527,986

[22] Filed: Sep. 13, 1995

[51] Int. Cl.[6] ..... A61G 13/00

[52] U.S. Cl. ..... 5/600; 5/601; 5/610; 5/611; 5/11

[58] Field of Search ..... 5/601, 610, 611, 5/11

[56] References Cited

U.S. PATENT DOCUMENTS

| | | | |
|---|---|---|---|
| 3,428,307 | 2/1969 | Hunter et al. | 5/611 |
| 3,588,500 | 6/1971 | Koerner | 5/601 |
| 4,452,439 | 6/1984 | Hogan | 5/601 |
| 4,568,071 | 2/1986 | Rice | 5/601 |
| 4,575,064 | 3/1986 | Menor | 5/601 |
| 4,650,172 | 3/1987 | Wathelet | 5/610 |

*Primary Examiner*—Lloyd A. Gall
*Assistant Examiner*—Fredrick Conley
*Attorney, Agent, or Firm*—James Lichiello; John H. Pilarski

[57] ABSTRACT

An electrophysiology table includes a dual section table top comprising a pair of elongated planar sections in superimposed planar to planar relationship. One of the table top sections is adapted to be manually moveable axially horizontally over the other section, the other section is electric motor powered for axial horizontal motion to advance the dual section table top to a new position where the manual moveable section is optimized. The table is also adapted to be vertically adjusted as well as to be tilted or angulated. With the two sections locked, the motorized section may move the table along the tilt slope.

10 Claims, 1 Drawing Sheet

ELECTROPHYSIOLOGY TABLE

BACKGROUND OF THE INVENTION

This invention relates to an improved electrophysiology table, and more particularly to a dual section adjustable table arrangement which facilitates manipulation and adjustment of such tables and persons or objects thereon.

An electrophysiology table usually comprises an elevating and tilting platform or structure to which an examining or treatment table top is attached. A person or medical patient, for example, reclines on the table top for diagnostic and medical treatment procedures. In some instances where a patient is to be subjected to certain x-ray practices including x-ray imaging techniques, it becomes necessary to adjustably move or position the patient with respect to the x-ray source. It is more convenient to move the table with respect to the x-ray source than to move the patient on the table. For this reason such a table is fitted with means to controllably change its position with respect to the x-ray source, for example, to change the vertical position of the table top, e.g. to raise or lower the table top platform, as well as to cause tilting, e.g. angular adjustment of the table top platform with respect to its horizontal position. When the table top is in its horizontal or untilted position, the table top includes moving means for extended linear or horizontal movement with respect to the x-ray source, a procedure referred to as panning the patient. In many instances such table top moving means may comprise only a manual operation where medical personnel physically move the table top which is equipped with slides or rollers, along its support. For x-ray panning purposes the movable table is required to be relatively long to permit viewing of all relevant anatomy and its slides or rollers must attach to non-imaging parts of the table. In order to provide more extended horizontal movement of the table in its horizontal position, the table base structure may be fitted with wheels which engage cooperating tracks in the floor of the examining room and the entire table structure together with the reclining patient is moved along the tracks. Tracks in the floor of a medical examining room pose both physical and medical hazards and are undesirable for those reasons. With a trackless and fixed base, a full range of patient adjustment may not be available for some procedures. With a movable base on directionless wheels, swivel wheels for example, precise patient positioning may be compromised.

Additionally, in some more complex x-ray procedures it may become necessary to reposition the patient on the table top in order to obtain full coverage of the patient because the extent or range of panning is limited. Repositioning a patient may also represent a hazard or otherwise be inconvenient and problematical. Manual panning of the patient for full length treatment or examination requires an extended length table, and for shorter tables, a repositioning of the patient. Alternatively, it will be necessary to move the table over extended distances, space permitting, to accomplish the procedure.

By means of the dual section table top of this invention, an additional and electric motor powered table top section is utilized to provide an extended linear or horizontal movement of the table top in addition to the movement available through manual manipulation, without the need for floor tracks. The combination of an added motorized table section together with manual manipulation not only provides full length patient panning or treatment, but also permits the use of a smaller original table for space conservation.

SUMMARY OF THE INVENTION

An electrophysiology table is provided with a dual section table top, one section of which is manually moveable or adjusted for patient positioning, and the other of which includes electric motor drive means for reciprocal horizontal adjustment movement. The range of movement of the manual section is additive to the movement range of the electric motor driven section so that full panning movement is achieved without movement of the entire table and its base.

This invention will be better understood when taken in connection with the following drawing and description.

DESCRIPTION OF A PREFERRED EMBODIMENT

Figure 1:
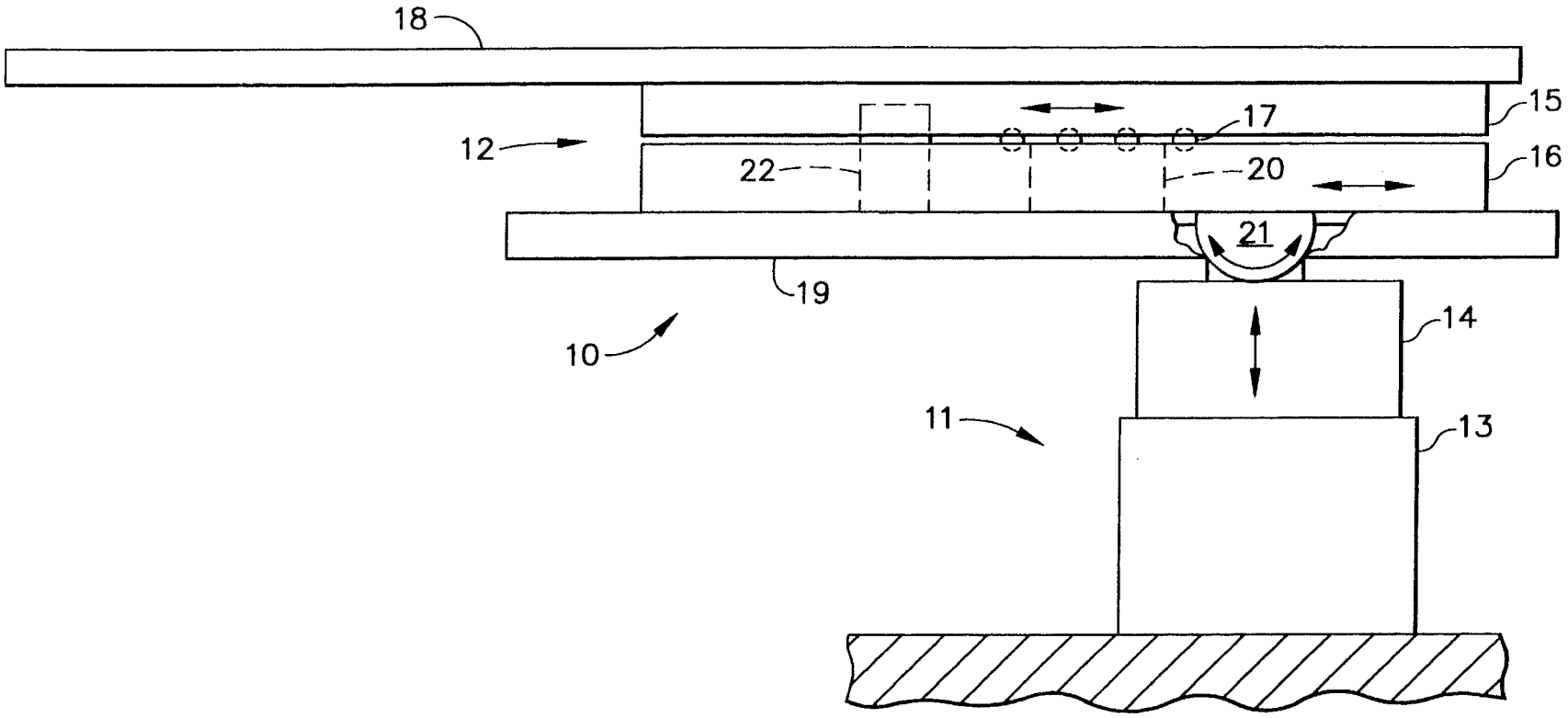
FIG. 1 is a schematic illustration of the dual section table of the present invention.

Referring now to FIG. 1, electrophysiology table 10 comprises a fixed supporting base 11 supporting a dual section table top 12 thereon. Support base 11 comprises a first unit 13 containing an electromotive, hydraulic etc. lifting mechanism to vertically position a lift unit 14, as indicated by its oppositely directed arrow, on which dual section table 12 and its supporting means are attached. Dual section table top 12 comprises an upper narrow elongated planar table top section 15 and a similar coplanar and supporting lower section 16. Upper section 15 is described as positioned in juxtaposed and superimposed planar to planar relationship on lower section 16. Upper section 15 is adapted to roll or slide on lower section 16 in a reciprocating manner as indicated by its included oppositely directed arrow. Such movement may be effectuated by various rolling elements, glides and slides to provide the desired relative motion between sections 15 and 16. As one example, rolling elements such as balls, rollers, or wheels 17 are illustrated between section 15 and 16. Accordingly upper section 15 may be freely manually moved in an unrestricted manner by ordinary examining room technicians for horizontal adjustment in opposite horizontal directions. Upper section 15 includes a further and fixed table top support 18 upon which a patient reclines for examination or treatment, In this invention a greater range of adjustment of table section 15 is provided by adapting lower table section 16 to be moved along a table support structure indicated generally at 19. Table support structure 19 is a support structure for dual section table top 12 and is adapted to have dual section 12 be axially movable therealong. As such, structure 19 may be a separate table 10 item or an integral part of the appropriate framework or housing of table 10, For the purpose of moving dual section table top 12 along support structure 19, structure 19 may be appropriately equipped with slides or rails which engage lower table section 16 for the described reciprocal motion.

For this purpose, electric motor drive means in the form of one or more small electric motors, together with a gear, chain, etc. drive is incorporated within table base section 16 and is generally illustrated by the phantom line enclosure 20. Drive means 20 is operative to move table base section 16 in a reciprocating manner horizontally with respect to the floor of the examining room. By this arrangement the horizontal position of table top 12 with a patient thereon is initiated by activating electric motor drive means 20 to drive dual section table 12 along its table support 19 to a new horizontal position, for example with respect to an external x-ray source. Should further horizontal positioning be required, upper table section 15 is manually moved to the desired position. The total distance a patient is to be moved is separated into a pair of movements or distances (1) a motorized movement of table 12, and (2) a manual movement of table section 15 over and along table section 16. The manual distance is additive to the motorized distance in determining the total distance required.

For a further range of patient manipulation, dual section table 12 is mounted for limited transverse rotation or pivoting on lift unit 14 through an electric motor and gear drive support assembly 21 positioned between and engaging table support structure 19 and lift unit 14 of support base 11. Assembly 21 is suitably controlled by the table operator or medical technician to provide a fore and aft rocking motion for angular positioning of table top 12 with a patient thereon. When table top 12 is tilted from its horizontal position, as illustrated in FIG. 1, to an angular adjustment, suitable locking or clutch means generally indicated at 22 is energized to fixedly lock table 12 sections 15 and 16 together to prevent undesirable relative motion therebetween because of the angular adjustment or tilt. Ordinary manual manipulation of upper table section 15 takes place without application of lock means 22 and may only occur only for horizontal adjustment because lock means 22 is utilized to prevent motion of table section 15 in the angular mode, During some x-ray procedures it may be desirable for a patient not only to be in a tilted position, but also be moveable along the tilt or angular slope and, for this purpose, lock means 22 is adapted through appropriate electrical control to permit adjusting linear reciprocating motion of table section 16 while in its tilted or angular position through its electric motor powered reciprocating adjustment arrangement 20. By means of appropriate controls for drive units 20 and 21 and lock means 22, table 12 may be adjusted along its horizontal or tilt axis without inadvertent or mistaken relative motion between its upper and lower sections, Electrical controls for all power sources and lock unit 22 are integrated in the usual manner into a central control unit easily accessible by the table technician. Furthermore, electrical circuitry is correlated with personnel safety as an important criteria, e.g., so that upper section 15 cannot be unlocked to slide off base section 16 when table 12 is tilted or energized for slope movement.

This invention provides an improved electrophysiology table having an extended horizontal range of movement by means of a base or platform supported superimposed dual section table top, wherein the superimposed or upper section is manually moveable over and along the lower section. The lower section is electric motor powered to place the manually moveable section in a more optimum horizontal position without the necessity of moving the table base. The table is further adapted for angular adjustment of the dual section table top 12 as well as for electric motor powered movement of the lower table section along the slope of the angular adjustment.

As used herein the terms "horizontal" and "angular" are to be defined with respect to the plane of the floor of the examining room upon which the table base rests.

This invention provides, in an electrophysiology table structure, a large number of available multiaxial motions for selective integration of certain of the multiaxial motions to position the examining or treating part of the table, i.e. the upper section 15 in an optional position. The table multiaxial motions include:

1. table elevation and lowering;
2. motorized table motion along a horizontal plane;
3. additive manual motion along the horizontal plane;
4. motorized rocking and tilt motion;
5. motorized movement along the slope of the rocking or tilt position.

Additionally with some modification manually movable upper table section 15 may be provided with some lateral motion from its described fore and aft axial motion, for example, where rollers 17 of FIG. 1 are ball elements arranged to provide or permit some limited and safe lateral motion of table section 15.

As described, table 10 of this invention includes favorable and supportive multiaxial motions as enumerated above where each motion takes place along or about separate axes and where four of the enumerated motions 1, 2, 4 and 5 are electric motor powered.

The range of motion of the table of this invention is adequate for all current procedures. For example, the motorized longitudinal panning of table 12 provides a significant linear adjustment and when this adjustment range is added to the manual panning adjustment range, the total adjustment not only equals or exceeds current needs, but also permits the use of shorter table tops to provide the required adjustment range.

While this invention has been disclosed and described with respect to a preferred embodiment, it will be understood by those skilled in the art that various changes and modifications may be made without departing from the spirit and scope of the invention.

What is claimed:

1. An electrophysiology table comprising in combination, (a) a fixed support base, (b) a table top support structure on said base, (c) a dual section table top supported by said table top support structure, (d) a lifting mechanism between said base and said table top support structure to vertically adjust said table top support structure with said dual section table thereon, (e) said dual section table top comprising a pair of narrow elongated upper and lower table sections in superimposed planar to planar relationship with means for providing axial relative motion therebetween so that the upper one of said sections is movable over and supported by the lower section, (f) and means for providing axial movement of said lower section along said table top support structure toner, her With said upper section thereon.

2. The invention as recited in claim 1 wherein said means for providing axial relative motion is adapted to permit free and unrestricted manual motion of said one section over said other section.

3. The invention as recited in claim 1 wherein said means for providing axial relative motion comprises rolling elements positioned between said table sections.

4. The invention as recited in claim 1 wherein said base includes a limited transverse rotation support assembly positioned between and engaging said support structure and said table top for providing angular adjustment of said table top.

5. The invention as recited in claim 1 wherein the said lower table top section of said dual section table top includes electric motor driving means for the purpose of providing movement of said dual section table top reciprocally along said table top supporting structure.

6. The invention as recited in claim 1 wherein said table sections include locking means for fixing their positions relative to each other and prevent relative motion therebetween.

7. The invention as recited in claim 5 wherein said driving means is adapted to move said table sections reciprocally along the slope of an angular adjustment of said table top support structure.

8. An improved electrophysiology table comprising in combination a plurality of drive means operable to provide a selection from multiaxial table motions to place said table in an optimal predetermined position, said table comprising (a) a fixed base, (b) a table top support structure on said base, (c) a dual section table top on said table top support structure, (d) said dual section table top comprising a pair of narrow elongated upper and lower table sections in superimposed planar to planar relationship, (e) and operative multiaxial driving means for providing multi axial motion of said table top to change its position with respect to said fixed base, said multiaxial driving means comprising, (1). a lift unit in said base to vertically adjust the position of said table top, (2). electric motor driving means between said base and said table top support structure for angular adjustment of said table top and (3). electric motor driving means in said table top to move said dual section table top to a different position, (f) and means for providing axial movement of said lower section along said table top support structure together with said upper section thereon.

9. The invention as recited in claim 8 wherein relative motion means is positioned between said upper and lower table sections for providing free and unrestricted movement of said upper section along said lower section.

10. The invention as recited in claim 8 wherein locking means is included in said table sections for locking said sections to each other to prevent relative motion therebetween for providing locking of said sections to each other to prevent relative motion therebetween.

* * * * *